United States Patent [19]

Meile

[11] 4,369,550

[45] Jan. 25, 1983

[54] METHOD OF LEVELLING OUT VARIATIONS OF A FIBRE SLIVER AND APPARATUS FOR IMPLEMENTING THE METHOD

[75] Inventor: Hanspeter Meile, Winterthur, Switzerland

[73] Assignee: Rieter Machine Works Ltd., Winterthur, Switzerland

[21] Appl. No.: 244,050

[22] Filed: Mar. 16, 1981

[30] Foreign Application Priority Data

Mar. 28, 1980 [CH] Switzerland ..... 2459/80

[51] Int. Cl.[3] ..... D01H 5/32; D01H 5/38

[52] U.S. Cl. ..... 19/240; 73/160

[58] Field of Search ..... 19/239, 240; 73/32 R, 73/160

[56] References Cited

U.S. PATENT DOCUMENTS

| | | | |
|---|---|---|---|
| 3,822,590 | 7/1974 | Tharpe | 73/160 |
| 3,938,223 | 2/1976 | Grice | 19/240 |
| 4,137,487 | 1/1979 | Niestroj et al. | 19/240 X |
| 4,184,361 | 1/1980 | Erben | 19/240 X |
| 4,199,843 | 4/1980 | Leifeld | 19/240 |
| 4,199,844 | 4/1980 | Goetzinger | 19/240 |
| 4,266,324 | 5/1981 | Hasegawa et al. | 19/239 |
| 4,267,620 | 5/1981 | Allen | 19/239 |
| 4,302,968 | 12/1981 | Moser | 73/160 |

FOREIGN PATENT DOCUMENTS

| | | |
|---|---|---|
| 1562564 | 4/1969 | France . |
| 2466526 | 4/1981 | France . |
| 2019460 | 10/1979 | United Kingdom . |

*Primary Examiner*—Louis Rimrodt

*Attorney, Agent, or Firm*—Werner W. Kleeman

[57] ABSTRACT

An autolevelling drawframe for levelling out staple fibre slivers in the spinning mill operation, in which deviations of the sliver weight (linear density) from the preset desired value detected are processed into correcting signals and are transmitted to a correcting member, which adapts the input speed of the drafting arrangement. The correcting signal transmitted is generated from the product of a voltage proportional to the rotational speed of the main motor and a voltage determined by the deviation in linear density. The apparatus consists of a computer (34,41; 60,41; 67,71) for computing the correcting signal, which computer is connected electrically with the correcting member (48), with a transducer (20) transmitting the voltage proportional to the rotational speed of the main motor, and with means for generating the voltage determined by the deviation in linear density. The computer can consist of a control device (36) and a multiplicator (41) or of a microprocessor (71) (digital computer).

16 Claims, 5 Drawing Figures

Figure 1:
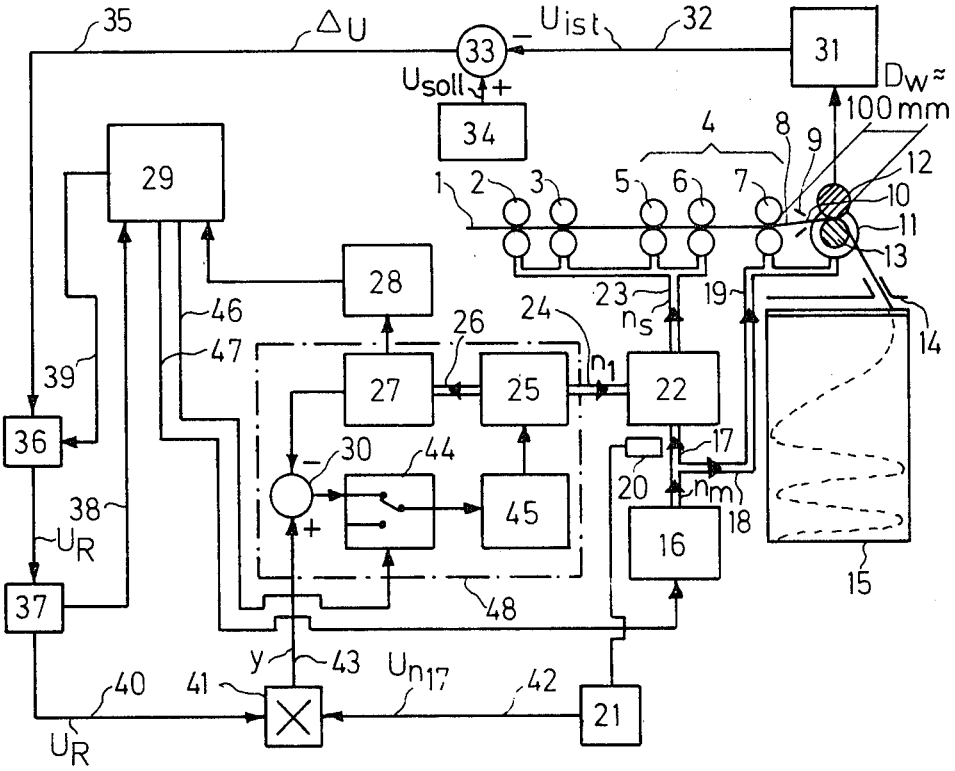

METHOD OF LEVELLING OUT VARIATIONS OF A FIBRE SLIVER AND APPARATUS FOR IMPLEMENTING THE METHOD

The present invention concerns a method of levelling out variations in linear density of a fibre sliver which is produced by drafting a plurality of individual slivers in a drafting arrangement and apparatus for implementing the method.

Autolevelling drawframes are already known, in which a measuring device measures deviations in linear density of the sliver at the delivery of the drawframe, compares them with a preset desired value, and in which detected deviations cause correction signals to be transmitted by a control device to the adapting element. The adapting element then adapts the input speed of the drafting arrangement and thus the main drafting rate until the linear density (or sliver count) of the sliver corresponds to the preset desired value. As the sliver passes through the measuring element after being subject to the controlled draft, the correction action thus automatically is checked continuously. Such closed loop control systems ensure outstanding sliver evenness values (USTER NEWS, Bulletin No. 24, October 1976, page 1).

Even if a control of this type functions satisfactorily during normal operation, it shows, however, considerable disadvantages. On high speed drawframes, as applied in practical use today, the drawframe is to be brought to a standstill for each change of the creel cans, in order to permit correct can change with clean sliver separation, and in order to avoid high mechanical stresses to the cans, or to the can changer, respectively. This results in the generation of a sliver defect caused during the stopping of the drawframe as well as during the start-up. This defect necessarily is caused during the stopping action and during the start-up, as the rotational speed of the input rolls of the drafting arrangement owing to auxiliary arrangements is maintained proportional to the rotational speed of the delivery rolls of the drafting arrangement, the draft ratio thus being maintained constant during these operation phases and no levelling out of the linear density being effected. This defect corresponds at the delivery speeds in practical use today of about 600 m/min to a sliver length of about 20 meters during the start-up phase and to a sliver length of about 10 meters during the stopping action to approximately the difference between the desired value and the actual value of the linear density of the input slivers. As the can change, if e.g. small capacity cans, as required for open end spinning, are filled, is effected in a change rhythm of 2 to 10 minutes, the defect described above is particularly disturbing. In order to generate the above mentioned defect over a short length only, the draw frame is started and stopped very rapidly. In such manner not only the sliver is stressed additionally, such that the danger of a sliver breakage occurs, but also the machine is unduly stressed.

It thus is the object of the present invention to overcome the above mentioned disadvantages and to create a method of levelling out deviations in linear density of a fibre sliver, and an apparatus for implementing the method, in which during the start-up phase as well as during the stopping action no deviations in linear density and no excessive stressing of the fibre sliver are caused, and using which the mechanical elements of the machine and the sliver cans are stressed minimally merely.

This object is achieved by the present invention characterized in the claims.

Figure 2:
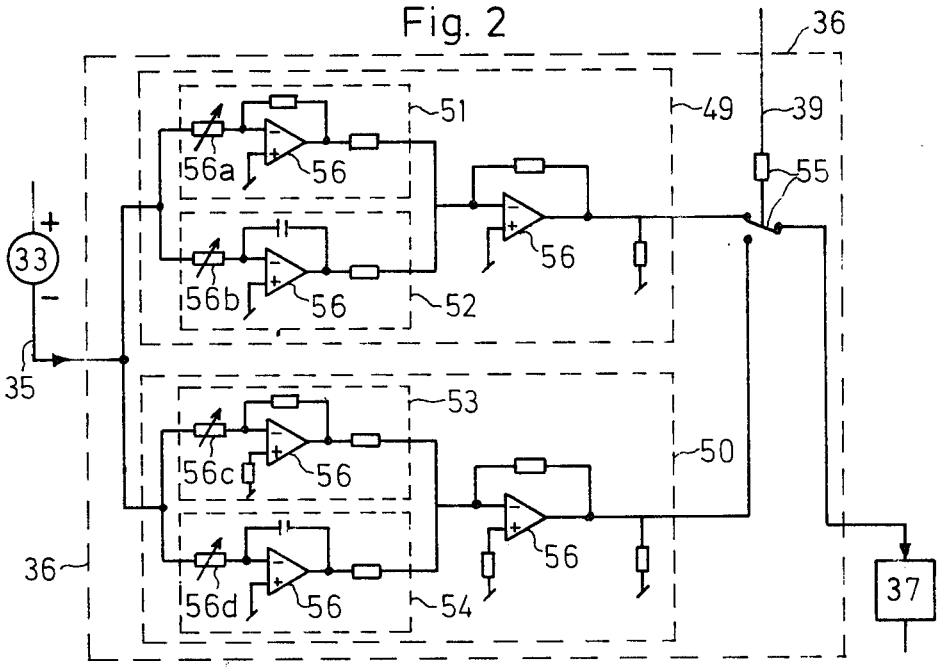
Figure 3:
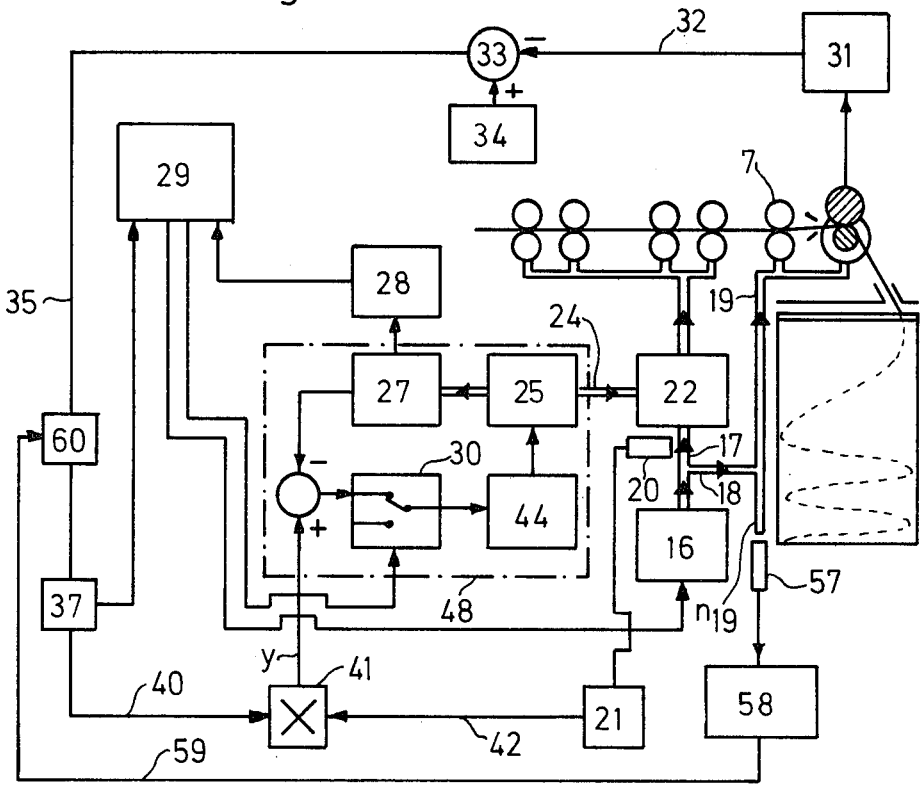
Figure 4:
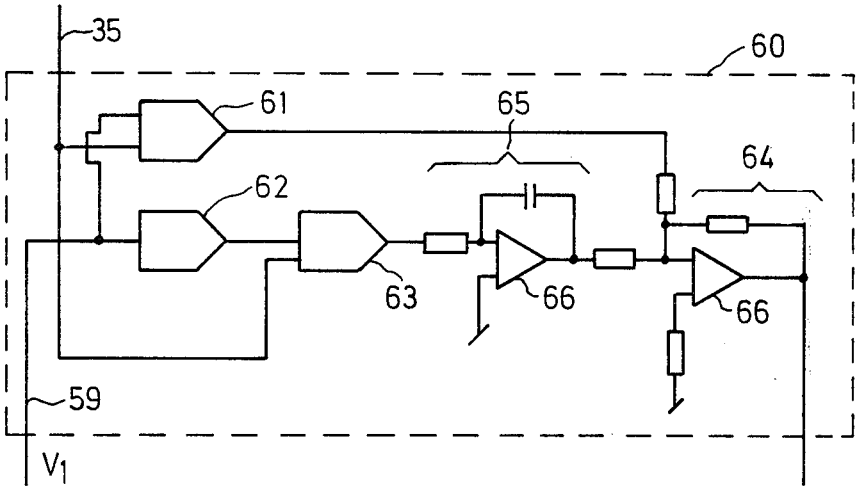
Figure 5:
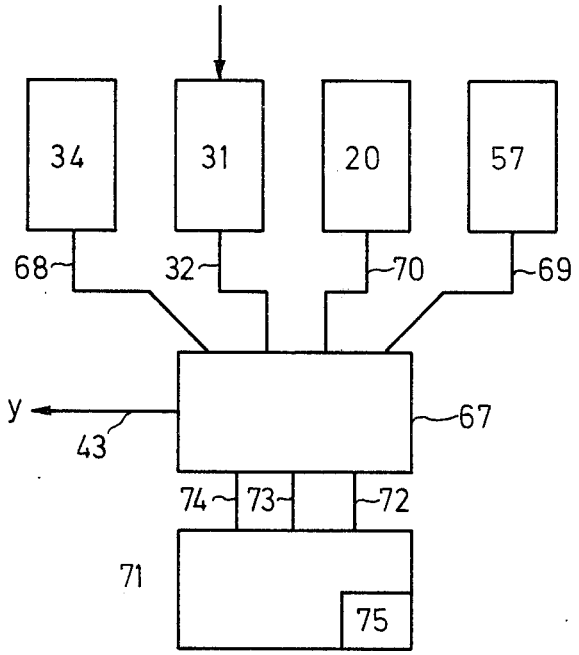

The present invention is described in more detail in the following with reference to illustrated design examples. It is shown in:

FIG. 1 is a schematic view of the drive of a drafting arrangement including a schematic indication of a levelling device of a drafting arrangement, FIG. 2 a schematic diagram of a control device, FIG. 3 an alternative design example of the apparatus according to FIG. 1, FIG. 4 a schematic diagram of an alternative control device suitable for the apparatus according to FIG. 3, FIG. 5 a schematic diagram of a digital circuit.

Draftable staple fibre sliver 1, which using pairs 2 and 3 of rolls of a feed table (not shown), are supplied to a drafting arrangement 4 of an autolevelling drawframe (not shown), and under a tensioning draft of about 1.05 are transferred at a speed $V_{einl.}$ to the pair 5 of input rolls, and from there are transferred to a pair 6 of rolls, the circumferential speed of which is higher according to the ratio of a chosen predraft, whereupon the main draft is effected using the pair 7 of delivery rolls with the circumferential speed $V_1$. Upon leaving the main drafting zone defined between the pairs 6 and 7 of rolls, the web 8 generated in the drafting arrangement is condensed laterally using a funnel 9 into a compact sliver 10 and is transferred to a pair of measuring rolls 11,12. This pair of measuring rolls can consist of a driven roll 11 containing a groove 13 and of the not drive counter-roll 12 complementary to, and meshing with the groove 13 of, the roll 11. The distance D between the pairs 7 and 11,12 of rolls in the draw frames in practical use today is of the order of about 100 mm. From there the sliver 10 via a turntable 14 is deposited in the can 15 arranged therebelow. The can 15 can be rotatingly driven or can be stationary.

For driving all rolls a main motor 16, designed as a stop motor, is used, which via the drive connections 17,18 and 19 drives the pairs 7 and 11,12 of rolls with a rotational speed which is constant and reduced at a rigid ratio. This rotational speed is chosen such, that the web 8, and the sliver 10 respectively, is transported at a speed of 600 m/min to about 800 m/min. An impulse signal transmitter 20, designed as a proximity initiator, cooperating with an element (not shown) of the drive connection 17 without contacting it, transmits a signal proportional to the rotational speed of the pair 7 of rolls, or of the pair of rolls 11,12 respectively, to a frequency/voltage transducer 21, which transmits a corresponding voltage signal $Un_{17}$.

The drive connection 17 furthermore transmits the rotational movement $n_{17}$ via a differential gear 22 and via a drive connection 23 at the rotational speed $n_5$ to the driven rolls of the pairs 2, 3, 5 and 6 rotating at a constant mutual speed ratio. The differential gear arrangement 22 furthermore is provided with a drive connection 24 driven at the variable rotational speed $n_1$ by a voltage controlled d.c. motor 25, which via a drive connection 26 also drives a control tacho-generator 27. The output points of the tacho-generator 27 are electrically connected on one hand side via a rotational speed checking device 28 with a motor control device 29 and on the other hand side with an adding element 30. The measuring roll 12 is mechanically connected with a signal transducer 31, which transmits, according to the deviation of the roll 12 caused by the sliver thickness (=local linear density), a representative signal via the circuit 32 to an adding element 33, which is connected with a manually setable potentiometer 34 for the desired value, which transmits a voltage signal $U_{soll}$. The adding element 33 transmits a voltage signal, which is proportional to the deviation of the linear density from the desired value of the linear density $U+U_{Soll}-U_{Ist}$ via a circuit 35 to a P-I control device 36, which is to be described in more detail later, where it is transduced into a voltage $U_R$ required for the control action and is transmitted to a control range checking device 37. This checking device 37 interrupts the connection 38 to the motor control device 29, if the preset control range is exceeded. The control device 36 furthermore is connected via the circuit 39 with the motor control device 29. A circuit 40 leads to a multiplicator 41, which on the other hand receives the signal $Un_{17}$ from the frequency-voltage transducer 21 via a circuit 42. The control device 36 and the multiplicator 41 together form an analog computer. The adding element 30, connected via circuit 43 with the multiplicator 41 supplying the correction value, via a contactor 44 and a power pre-amplifier 45 to the d.c. motor 25. The output points of the motor control device 29 furthermore are provided each with a connecting circuit 46,47 to the contactor 44 and to the main motor 16. As the preset maximum rotational speed of the d.c. motor 25 is exceeded, the rotational speed checking device 28 effects deactivation of the motor 25 via the motor control 29. The elements 25,27,30,44 and 45 form the correcting element 48 of a closed loop control circuit.

The structure of the control device 36 is shown in FIG. 2. It consists of an inert P-I control device 49, to be activated for the stop-start phase, and of a fast P-I control device 50, to be activated for the normal operating phase.

The control device 49 is provided with the following characteristics:

for an amplifier stage 51 for the P-portion: K=0–0.1, for an amplifier stage 52 for the I-portion: $T>2\cdot10^{-1}$ sec.

and the control device 50 with the characteristics:

for an amplifier stage 53 for the P-portion:

$$K=6.7\cdot10^{-4}V_1 \text{ (m/min)}$$

for an amplifier stage 54 for the I-portion:

$$T_{(sec)}=22{,}500/V_1^2 \text{ (m/min)}$$

The above mentioned characteristics are laid out with reference to a path distance $D_w\approx100$ mm, as measured between the nip lines of the pair 7 of rolls and of the pair of measuring rolls 11,12.

Switching from the start-up phase to the normal operating phase and from there to the stopping phase is effected via the circuit 39 by the motor control device 29 via a switch 55. The operation amplifiers 56 provided in the control device 36 are commercially available, e.g. Type 6P 3521 from Burr Brown, International Airport Park, P.O. Box 11400, Tuscon, AZ, USA.

During the start-up phase the apparatus now functions as follows: The voltage ΔU supplied via the circuit 35 first is transmitted to the inert control device 49, and then the control voltage supplied by this control device 49 is transmitted via the switch 55, which by the motor control device 29 is brought into the position shown in FIG. 2, to the control range checking device 37. As a delivery speed $V_1$ of e.g. about 500 m/min is reached, the switch 55 is activated and the fast control device 50 receives the signal ΔU from the circuit 35, such that the normal operating phase is initiated. As the drawframe is brought to a standstill the same operations are effected in reverse sequence. The structure and the function incorporating an additional inert control device 49 are required in order to avoid, that the control device during the start-up phase overshookingly oscillates due to the lack of inertion (the inertion being undesirable during the normal operation), and that thus the drafting arrangement 4 generates faulty drafts and sliver breakages. The control device 49 as well as the control device 50 are to be adapted to the changing operating conditions by correspondingly adapting the settings. In the control device 49 adaptation of the setting using the potentiometer **56*a* wired in before the operation amplifier 56 and the potentiometer 56*b* of the RC-member to the acceleration and to the deceleration of the machine is required. This adaptation depends on the operating speed to be reached. An adaptation to the material to be processed is required as the drafting forces depend on the material in process. The mass inertia of the sliver cans including their contents also are to be taken into account. The momentary operating conditions, i.e. whether the machine already is warm from running or whether it is starting cold, also are to be taken into account for the settings. For the stopping phase additionally the influence of varying wear of the brake linings in the motor 16** (stop motor) is to be considered.

The control device 50 requires adaptation, if the delivery speed is changed, e.g. if an operating speed of 400 m/min is chosen instead of 500 m/min by adapting the corresponding potentiometers **56*c* and 56*d***. This adaptation of the settings, however, in case of changes in the operating conditions, should not be omitted, which requires reliable operators.

The apparatus further functions as follows:

In the multiplicator 41 the correcting value y, required for levelling out the deviations in linear density of the fibre sliver 10 is continuously determined by multiplying the voltage signals transmitted via the circuits 40 and 42, and the correcting value y is transmitted to the correcting element 48, which in turn acts via the differential gear arrangement 22 upon the rotational speed of the rolls 2, 3, 5 and 6 of the drafting arrangement, correcting their speed in such manner that continuously deviations in linear density in the sliver to be drafted are levelled out until the desired value is reached.

During the start-up phase the main drive motor 16 is accelerated from standstill to its constant operating rotational speed n, with respect to which the rotational speed $n_{17}$ is in a fixed relation determined by change gears (not shown). The motor control 29 is provided with a timer (not shown), such that the control circuit is activated already as the main motor 16 is started and is deactivated only as the motor 16 comes to a standstill. In this manner the d.c. motor 25 forming the control drive is electrically coupled with the main drive motor 16 during the start-up phase and the stopping phase of the drawframe. This is effected as the impulse signal transmitter 20 continually determines the momentaneous rotational speed $n_{momentan}$ of the pair 7 of rolls also during the start-up and the stopping phases in such a manner that in the multiplicator 41 continually the product of the signals $U_R \times Un_{17}$ is formed, which is required for levelling out the corresponding deviations in linear density. Thus the rotational speed of the rolls 2, 3, 5, 6 automatically follows proportionally the rotational speed of the rolls 7, 11, 12, and a correct start-up, and a correct slowing down thus is achieved.

The structure and the function of the apparatus according to FIG. 1 can be further improved for elimination of the setting operations requiring skill, in that the frequence, generated by the impulse signal transmitter 57 (FIG. 3), which is proportional to the delivery speed $V_1$, i.e. to the rotational speed $n_{17}$, is transmitted to the frequency/voltage transducer 58, which transmits a voltage $U_{59}$ via the circuit 59 to a P-I control device 60. The signal from circuit 59 (FIG. 4) is received by the multiplicators 61 and 62, whereas the one from the circuit 35 is received by the multiplicator 61 and by a multiplicator 63. The multiplicator 61 supplies a signal $V_1 \times \Delta U$ (linear density) of an amplifier stage for the P-portion 64 and the multiplicator 63 receives a signal each $V_1^2$ from multiplicator 62 and $\Delta U$ from circuit 35 and transmits their product $V_1^2 \cdot \Delta U$ to the amplifier stage 65 for the I-portion. Both amplifier stages 64 and 65 are provided each with an operation amplifier 66, of the Type 2521L from the Burr Brown Company. The multiplicators 61–63 are of the Type 4203 from the same Company. The signal given off to the circuit 40 thus corresponds to the sum $V_1 \times \Delta U + \int V_1^2 \cdot \Delta U \cdot dt$ and is supplied to the multiplicator 41 as a value depending on the linear density and on the delivery speed. The control device 60 and the multiplicator 41 again form the analog computer.

In the inventive arrangements automatically during the start-up and the stopping phases the change in rotational speed of the d.c. motor 25 required is maintained proportional to the delivery speed of the sliver 10, i.e. the input speed of the slivers 1 changes proportionally to the delivery speed of the sliver 10, and thus the main-draft, as desired, is independent of the rotational speed $n_{17}$. Furthermore, the control parameters during the start-up phase automatically change in desired manner from inert to fast and vice versa during the stopping phase. This signifies, that for *any* delivery speed the control device is set optimally without any manual setting adaptations. As the start-up phase and the stopping phase are being taken care of correctly independently of the rotational speeds of the rolls of the drafting arrangement, the start-up and stopping phases can be effected slowly (i.e. over 5 to 10 seconds, at operational speeds of up to 800 m/min). This results in a considerable reduction of the mechanical stresses, as abrupt braking action and start-up of the machine are dispensed with and in a reduction of the danger of sliver breakage.

The analog circuit arrangements described above with reference to FIGS. 3 and 4 advantageously can be replaced by the digital circuit arrangement according to FIG. 5 described in the following. The elements 20, 31, 34 and 57, as well as the circuit 32 correspond to the ones shown in FIG. 3. They are designated with the same reference signs in FIG. 5.

A periphery platine 67 consists of an analog/digital-transducer (not shown) (e.g. Burr Brown Type ADC 85-12) for the input of the analog effective value signal (circuit 32) from the signal transducer 31, a circuit (not shown) for reading digital data (e.g. Type SN 74 LS 241 from Texas Instruments Inc., MOS Microcomputer Products, Box 1443 MS 6404, Houston, TX 77001, USA) for the digital input from the circuits 68, a frequency/time-transducer (not shown) consisting of oscillators and counters commercially available for the signals from the circuits 69 and 70, as well as corresponding auxiliary circuit arrangements (not shown) for decoding the addresses and for generating the required control signals and auxiliary signals, a digital-analog-transducer (not shown) (e.g. Burr Brown DAC 71-COB-V) for the output (via circuit 43) (correcting value signal y).

A microprocessor 71 cooperating with the platine 67 (e.g. Texas Instruments, Type TM 990/100 M) is connected with data bus lines 72, address bus lines 73 and control bus lines 74. The microprocessor 71 using a plugable Eprom-Storage 75 (e.g. Type TMS 2716 from Texas Instruments, Inc.) is provided with the required computing programme, which is defined by the control algorhythm $$y = c_1 \cdot V_{einl.} \left( \Delta U \cdot V_1 + \frac{c_2}{T} \int_T \Delta U \cdot V_1^2 \cdot dt \right)$$

where $c_1$ and $c_2$ are constants, $V_{einl.}$ is the input speed of the fibre sliver at the pair 5 of rolls, T is the integration time.

The platine 67 now processes the input signals, as called in by the microprocessor 71 and as exchanged via the data bus line 72, the address bus line 73 and the control bus line 74, and transmits the computed results in the form of a correcting value signal y to the circuit 43 to be transmitted to the correcting device 48.

This digital solution offers a number of particular advantages:

1. Exact maintenance of the linear density of the fibre sliver delivered over a prolonged period of time and independently of outer conditions in the spinning mill (such as e.g. air temperature, humidity), as drifting of electronic components is eliminated. Checking, readapting and re-calibration can be dispensed with, is of considerable importance in view of the shortage of skilled personnel in the spinning mills.

2. High flexibility in operation.

A programme change, e.g. a new control algorhythm or other parameters, can be effected easily by exchanging the Eprom-storage device. Also additional disturbance factors can be inserted easily if desired.

3. Additional control functions, such as e.g. detection of a sliver breakage, computing, registering, display and, if desired, monitoring of the $C_V$-values of the sliver delivered can be effected without expensive complications.

I claim:

1. Method of levelling out variations in linear density of a fibre sliver drafted from a plurality of fibre slivers in a drafting arrangement of an autolevelling draw-frame, the linear density of which sliver is measured at the exit of the drafting arrangement and is compared with a preset value, a signal proportional to deviations in linear density being transmitted to a control device, which in turn transmits the adaptation commands using an adaptation value to adaptation means, which adjust the sliver input speed using a differential gear arrangement driven by the main motor and by a control motor, until the preset value is reached, characterized in that the adaptation value transmitted to the adaptation means (48) is formed by the multiplication product of a voltage proportional to the rotational speed of the motor and of a voltage determined by the deviation in linear density.

2. Method according to claim 1, characterized in that the voltage determined by the deviation in linear density is generated by a P-I control device.

3. Method according to claim 1, characterized in that the voltage determined by the deviations in linear density during the start-up and running down phases of the drawframe is generated by a P-I control device laid out with sufficient inertia to avoid overshooting oscillation.

4. Method according to claim 3, characterized in that the voltage determined during the normal operating phase is generated by a fast P-I control device maintaining deviations from the preset value to a minimum.

5. Method according to claim 1, characterized in that the voltage determined is influenced by a signal, which is a function of the running-down speed $V_1$ of the drawframe.

6. Apparatus for implementing the method according to claim 1, characterized in that a computer (34,41; 60,41; 67,71) is provided for generating the adaptation value from the multiplication product of the voltage proportional to the rotational speed of the motor as supplied by a transmitter (20) and of the voltage determined according to the deviation in linear density, and that the computer (36,41; 60,41; 67,71) for transmitting the adaptation value is connected electrically with the adaptation means (48), which in turn is connected mechanically via a differential gear arrangement (22) with the input roll drive (23).

7. Apparatus according to claim 6, characterized in that the computer (36,41; 60,4) is formed by a control device (36,60) receiving the voltage representing the deviation in linear density, and by multiplicator device (41) supplied by the latter, which on one hand side is connected with the adaptation means (48) and on the other hand side with the transmitter (20).

8. Apparatus according to claim 7, characterized in that the control device (36) comprises an inert P-I control device (49) which can be activated during the start-up phase and the run-out phase, and a fast P-I control device (50) which can be activated during the normal operating phase.

9. Apparatus according to claim 8, characterized in that the inert P-I control device (49) has the characteristics $K=0$–$0.1$ (P-portion) and $T>2\cdot10^{-1}$ sec. (I-portion) for a distance from the pair of delivery rolls (7) of the drafting arrangement to the pair of measuring rolls (11,12) of about 100 mm.

10. Apparatus according to claim 9, characterized in that the fast P-I control device has the characteristics $K=6.7\cdot10^{-4}\ V_1$ (m/min) and $T_{(sec)}=22{,}500/V_1^2$ (m/min) for a distance of about 100 mm from the pair of delivery rolls (7) of the drafting arrangement to the pair of measuring rolls (11,12).

11. Apparatus according to claim 8, characterized in that the control device (36) for switching from the start-up and run-out phases to the normal operating phase is connected with a motor control device (29).

12. Apparatus according to claim 11, characterized in that the motor control device (29) controls the adaptation means (48) as well as the main motor (16) and is connected with a control range scanner (37) and with a rotation speed scanner (28).

13. Apparatus according to claim 8, characterized in that the control device (60) additionally is connected with the signal transmitter (57), which transmits a signal proportional to the drawframe delivery speed $V_1$ (FIG. 3).

14. Apparatus according to claim 8, characterized in that the control device (60) automatically adopts the characteristics $K=6.7\cdot10^{-4}\ V_1$ (m/min) and $T_{(sec)}=22{,}500/V_1^2$(m/min) in function of the voltage proportional to the delivery speed, which is supplied to it, the distance between the pair of delivery rolls (7) from the measuring rolls (11,12) being about 100 mm.

15. Apparatus according to claim 6, characterized in that the computer (67,71) is formed by a microprocessor (71) which is connected with the transmitter (20) with the means (31,34) transmitting the signal determined by the deviation of the linear density and with the adaptation means (48).

16. Apparatus according to claim 15, characterized in that the microprocessor operates according to the following control algorhythm:

$$y = c_1 \cdot V_{einl.}\left(\Delta U \cdot V_1 + \frac{c_2}{T} \int_T \Delta U \cdot V_1^2 \cdot dt\right),$$

where $c_1$ and $c_2$ are constants, $V_{einl.}$ is the speed of entry of the fibre sliver into the drafting arrangement, and T is the integration time.

* * * * *